US005623576A

United States Patent [19]

Deans

[11] Patent Number: 5,623,576

[45] Date of Patent: Apr. 22, 1997

[54] DOWNHOLE RADIAL FLOW STEAM GENERATOR FOR OIL WELLS

[75] Inventor: Harry A. Deans, Laramie, Wyo.

[73] Assignee: Meshekow Oil Recovery Corporation, Beverly Hills, Calif.

[21] Appl. No.: 280,739

[22] Filed: Jul. 26, 1994

Related U.S. Application Data

[63] Continuation-in-part of Ser. No. 96,377, Jul. 26, 1993, abandoned.

[51] Int. Cl.[6] ..... E21B 36/04; F22B 1/30; H05B 3/60

[52] U.S. Cl. ..... 392/303; 392/305; 392/306; 166/60

[58] Field of Search ..... 392/301, 303, 392/305, 306; 166/60, 302

[56] References Cited

U.S. PATENT DOCUMENTS

| | | | |
|---|---|---|---|
| 4,127,169 | 11/1978 | Tubin et al. | 166/60 |
| 4,378,846 | 4/1983 | Brock | 392/301 |
| 4,783,585 | 11/1988 | Meshekow | 392/303 |
| 5,070,533 | 12/1991 | Bridges et al. | 392/301 |
| 5,120,935 | 6/1992 | Nenniger | 392/305 |

FOREIGN PATENT DOCUMENTS

| | | | |
|---|---|---|---|
| 2128761 | 1/1995 | Canada . | |
| 827757 | 5/1981 | U.S.S.R. | 166/60 |
| 1298354 | 3/1987 | U.S.S.R. . | |

*Primary Examiner*—John A. Jeffery
*Attorney, Agent, or Firm*—Harlan P. Huebner

[57] ABSTRACT

A downhole radial flow steam generator for oil wells that includes an annular casing and a water passage extending therethrough with a porous medium between the casing and passage with electrode means within the generator to heat the water into steam or hot water wherein the fluid is directed radially through the medium and the annular casing into a preselected earth strata to heat oil therein and reduce its viscosity for pumping to the surface.

20 Claims, 9 Drawing Sheets

FIG. 1
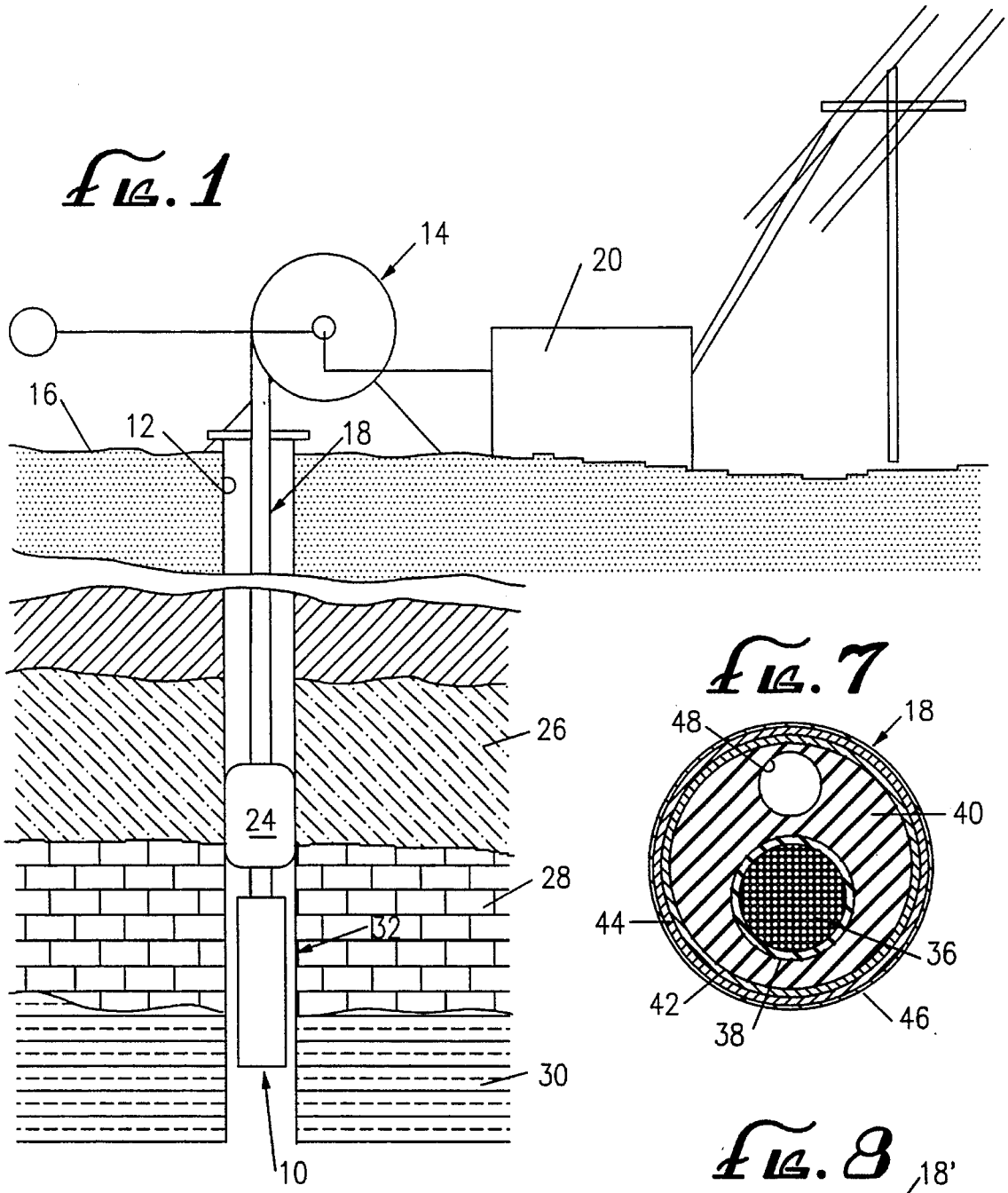
FIG. 7
FIG. 8
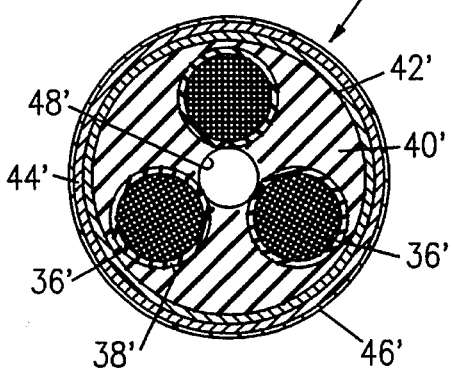

FIG. 16
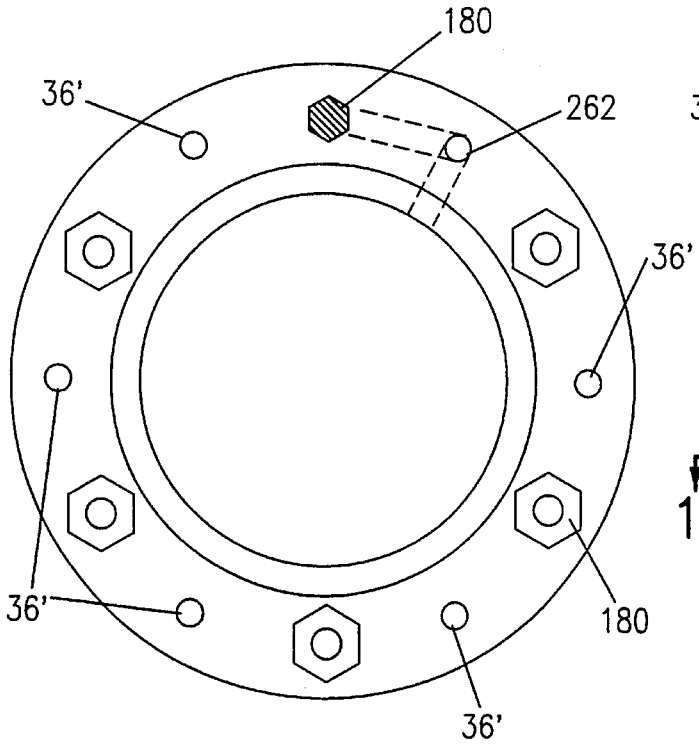
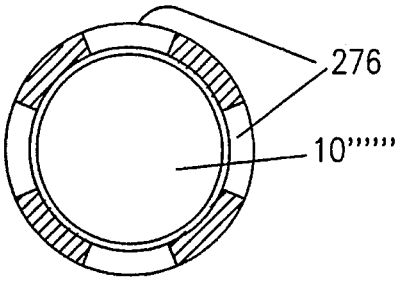
FIG. 18
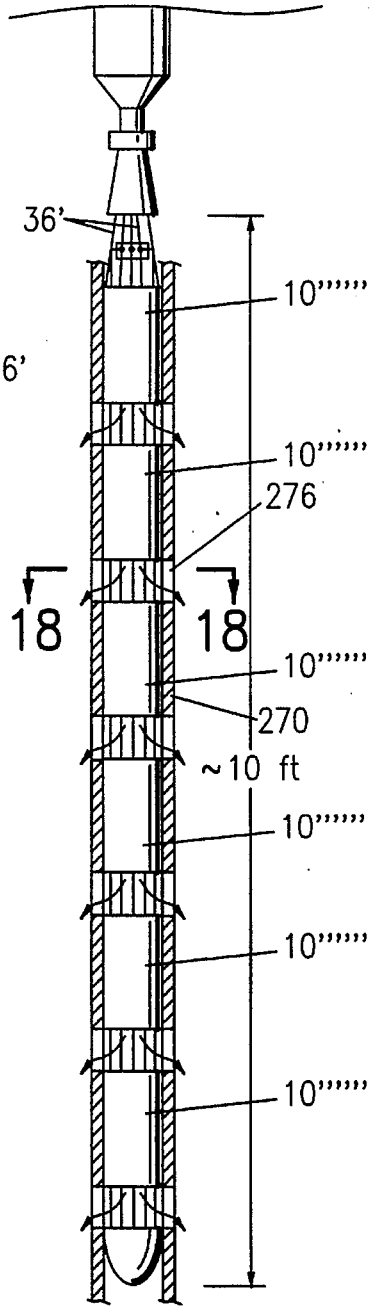
FIG. 17

DOWNHOLE RADIAL FLOW STEAM GENERATOR FOR OIL WELLS

This is a Continuation-In-Part of Ser. No. 08/096,377, filed Jul. 26, 1993, now abandoned.

BACKGROUND OF THE INVENTION

1. Field of the Invention

This invention relates to a downhole steam generator for oil wells wherein the steam will pass out radially through a new generator construction.

2. Description of the Prior Art

In the prior art steam or hot water generators for use in oil well bores there is that described and claimed in Meshekow U.S. Pat. No. 4,783,585. Such a structure while usable does not possess a radial steam flow.

Also, the generator structure as illustrated in Meshekow U.S. Pat. No. 5,142,608 is directed to horizontal oil well drilling and contains limitations or particulars that are only applicable to "horizontal type" drilling. Again, such structure does not possess a radial steam flow.

One of the disadvantages of some prior art steam generators is "scaling" or the building up of minerals and salts from the feedwater used to generate the steam.

In addition, the prior art steam generators have been divided into uses, i.e., vertical or horizontal, in that there has not been one universal generator that could be used in all types of oil boreholes.

SUMMARY OF THE INVENTION

It is a purpose of the present invention to provide a downhole steam generator for use in oil wells that is structurally capable of being used in vertical, horizontal or deviated oil well bores.

A further object of the present invention is to provide a downhole steam generator for use in oil wells wherein the construction of the generator allows the generated steam to radially exit the generator.

Another object of the present invention is to provide a downhole steam generator that utilizes electricity to form the steam and as such helps to reduce air pollution relative to where some such devices which use oil burners at the ground surface to produce steam.

A still further object of the present invention is to provide a downhole steam generator for use in oil wells that includes new and novel cable means to lower the generator from the surface wherein the cable contains power and water feed means within the cable.

Another object of the present invention is to provide a downhole steam generator for use in oil wells with simultaneous flow of steam and blowdown water through a slightly conducting or non-conducting porous medium within the generator.

Another object of the present invention is to provide a downhole steam generator for use in oil wells that includes porous packing material that can effectively use a large range of voltages to convert the water to steam.

A yet further advantage of the present invention is to provide a downhole steam generator for use in oil wells that may use water of varying salinity content.

Another object is to provide a downhole steam generator for use in oil wells where a plurality of generators may be linked together for use downhole in one or more strata of oil to pump steam therein to create an oil of low viscosity so that the same may be more easily pumped to the surface.

A still further object of the present invention is to provide a downhole steam generator for use in oil wells that includes sintered metal electrodes having a greater than conventional surface area for expediting steam generation and allows steam and/or water to pass through.

A yet further object of the present invention is to provide a downhole steam generator for use in oil wells wherein the electrodes that are used in the generator are annular disks that project outward to an exterior generator casing.

Another object of the present invention is to provide a downhole steam generator for use in oil wells that may include at the ground surface at least one positive water displacement pump to isolate the water supply to each phase of the generator.

Another object of the present invention is to provide a downhole steam generator for use in oil wells wherein there is a stable boiling of water within the porous medium of the generator, thus eliminating entrainment of the water, and producing even distribution of steam.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be clearly understood from the following detailed description and by reference to the drawings in which:

FIG. 1 is an environmental view partly in cross section of the steam generator as it would appear underground with support structures on the surface;

FIG. 7 is a cross-sectional view of the downhole cable with a form of power and water feed within the cable;

FIG. 8 is a modified power and water feed within the cable;

FIG. 16 is an end view of the modified generator of FIG. 15;

FIG. 17 is a sectional view of a plurality of steam generators of FIG. 15 in tandem arrangement; and FIG. 18 is a cross-sectional view taken on line 18—18 of FIG. 17;

DETAILED DESCRIPTION OF THE PREFERRED EMBODIMENT

Figure 2:
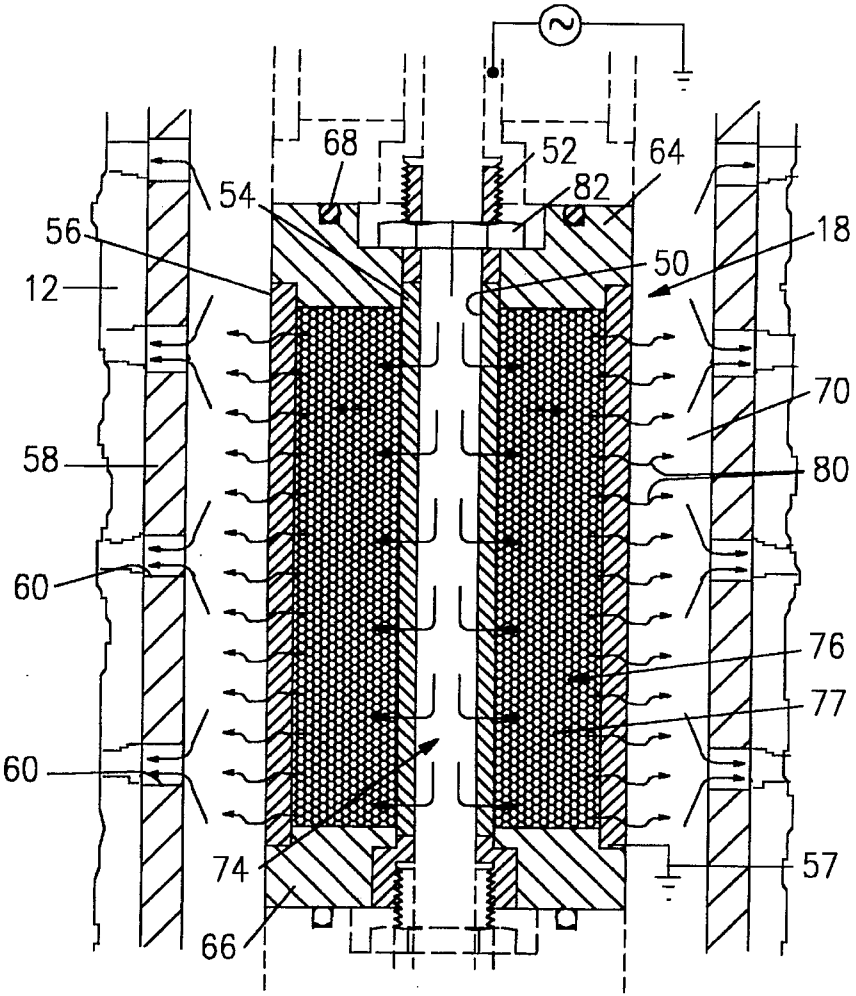
FIG. 2 is a cross-sectional view of the steam generator of the present invention.

FIG. 1 illustrates one form in which the subject invention a downhole radial flow steam generator generally designed 10 may be deployed in a downhole bore 12. A reel designated 14 may be mounted on the earth's surface 16 that is power actuated to raise and lower through the various strata 26 to the designed target formation 28 and 30.

There is preferably a water source 20 which will include a water pump to pump water or a water salt brine through the cable 18 to be described. In the generator 10, steam 32 will be created to be radially expelled from the generator into the target formations 28 and 30 to warm up oil therein where viscosity is reduced to allow the pumping of oil to the surface by any conventional means.

When generator 10 reaches the desired location, a packer member 24 may be inflated with water or hydraulically activated to act as a seal preventing the upward dissipation of steam. While the packer number 24 is illustrated and preferred it is not essential to the operation of the generator 10.

The cable 18 is illustrated in cross section in FIGS. 7 and 8. This cable 18 in FIG. 7 is known as a single phase cable due to the fact there is a single electrical cable 36 that includes insulation 38 surrounding the cable 36 that in turn is mounted in a non-conductive medium 40. This is in turn surrounded by an outer annular conductor number 42, insulation 44 and an outer metallic sheath 46. Within the single phase cable 18 of FIG. 7 there is a bore 48 through which water being pumped from the surface passes through to the generator 10.

Turning now to FIG. 2 there is illustrated a single phase generator 10. The generator 10 preferably includes as inner sintered metal cylinder electrode 50, which carries current from the single electrical conductor 36 when the cable 18 is connected to threaded coupling 52 at the top 54 of the cylinder electrode 50.

The generator 10 also includes an outer cylindrical casing electrode 56, preferably of sintered metal, which is in contact with fluid in the annulus 18, which is at electric ground potential. Each of the electrodes 50 and 56 being porous, feedwater may pass therethrough. Usually in the downhole bore 12 the casing is between five and seven inches in diameter. The steam generated and the blowdown water 80 will be conducted through a plurality of openings or perforations 60 that communicate with the target oil formation 28, 30.

At the top of the electrodes 50 & 56 there is fitted an upper annular end piece 64 which is of a non-conductive composite material which insulates between the electrodes 50 and 56. There also is a lower annular end piece 66 that serves the same purpose as upper annular end piece 64.

The upper annular end piece 64 may also be fitted with an O ring seal 68 which seals and insulates the feedwater passage 74 from the annular space 70 created between the casing 58 and outer cylinder 56 of the generator 10. The feed water 72 represented by the arrows in FIG. 2 passes down the water passage 74 created within the inner cylinder electrode 50.

The water or brine (not shown) will be pumped from the surface down cable bore 48 into passage 74.

As can be seen, the generator 10, in FIG. 2 has coupling capacity at the top and bottom so that it may be attached to similar generators above and below with electricity passing through the single phase of cable 18 into the respective electrodes.

Packed between the inner and outer cylindrical electrodes 50 and 56 is a porous medium 76. The medium is preferably non-conducting packing beads 77 which provide flow resistance to the water and steam flowing radially, see arrows 80, and also helps to reduce the electrical conductivity of the space between the inner electrode 50 and the outer cylinder electrode 56. The beads 77 may be of a ceramic material or other material that might be just slightly conductive without departing from the spirit of the inventor.

Thus, as the water flows down the bore 74 and out through the packing 77, electric current flowing through the water between the electrode 50 and the outer electrode 56 causes the water to turn to steam which radiates outward as seen by the arrows, out the outer cylinder through the openings or perforations 60 into the strata 28 and 30 to lower the viscosity of the oil therein.

If there is a lower generator 10 connected to that shown in FIG. 2 the feed water will continue down the bore 74 into second generator and the same radial passing and heating will take place.

In addition, the water represented by the arrows 72 is also conducting the current while passing through the porous medium 76 where it is heated and vaporized into the steam which passes through the outer porous electrode 56 as shown by the arrows 80.

With the arrangement of the electrodes and porous medium 76 the steam and residual liquid water carries all the dissolved solids in solution in the water which flows into the strata 28. This in turn prevents scale formation within the porous medium 76 or the sintered outer electrode cylinder 62.

As can be seen in FIG. 2 the generator 10 is held together by the closure nut 82 on the threaded end 52.

Figure 3:
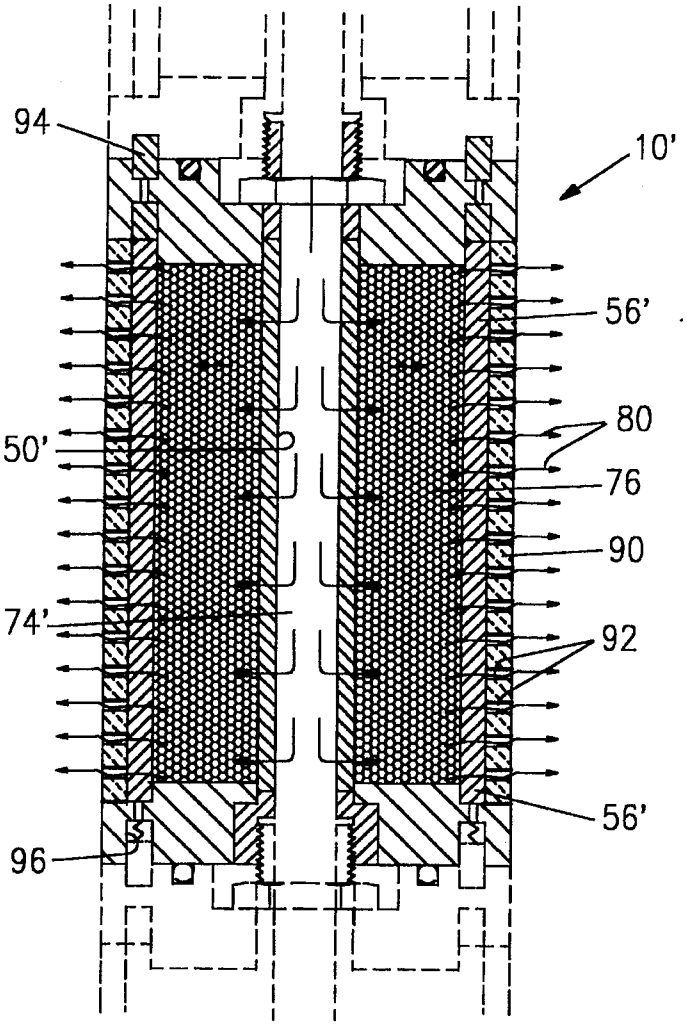
FIG. 3 is a cross-sectional view of a modified steam generator of FIG. 2.

While the outer electrode cylinder 56 is preferably that as shown in FIG. 2, there can be an outer insulation cylinder 90, see FIG. 3, that includes perforations 92 for the steam, arrows 80.

The other difference that the FIG. 3 generator 10' has over the FIG. 2 structure resides in the inclusion of an annular electrical contact ring 94 that contacts the annular outer cylindrical electrodes 56'. This provides an internal path for ground current to the connector cable ground 42, as seen in FIG. 7. In case there is need for a second tandem generator 10' below, an annular recess 96 is provided to receive ring 94.

Again, the generator 10' with the single phase cable connected to the outer sintered metal conductor cylinder 56' and the inner conductor cylinder 50', will allow water to pass down the passage 74' and pass out into the porous medium 76'.

Figure 4:
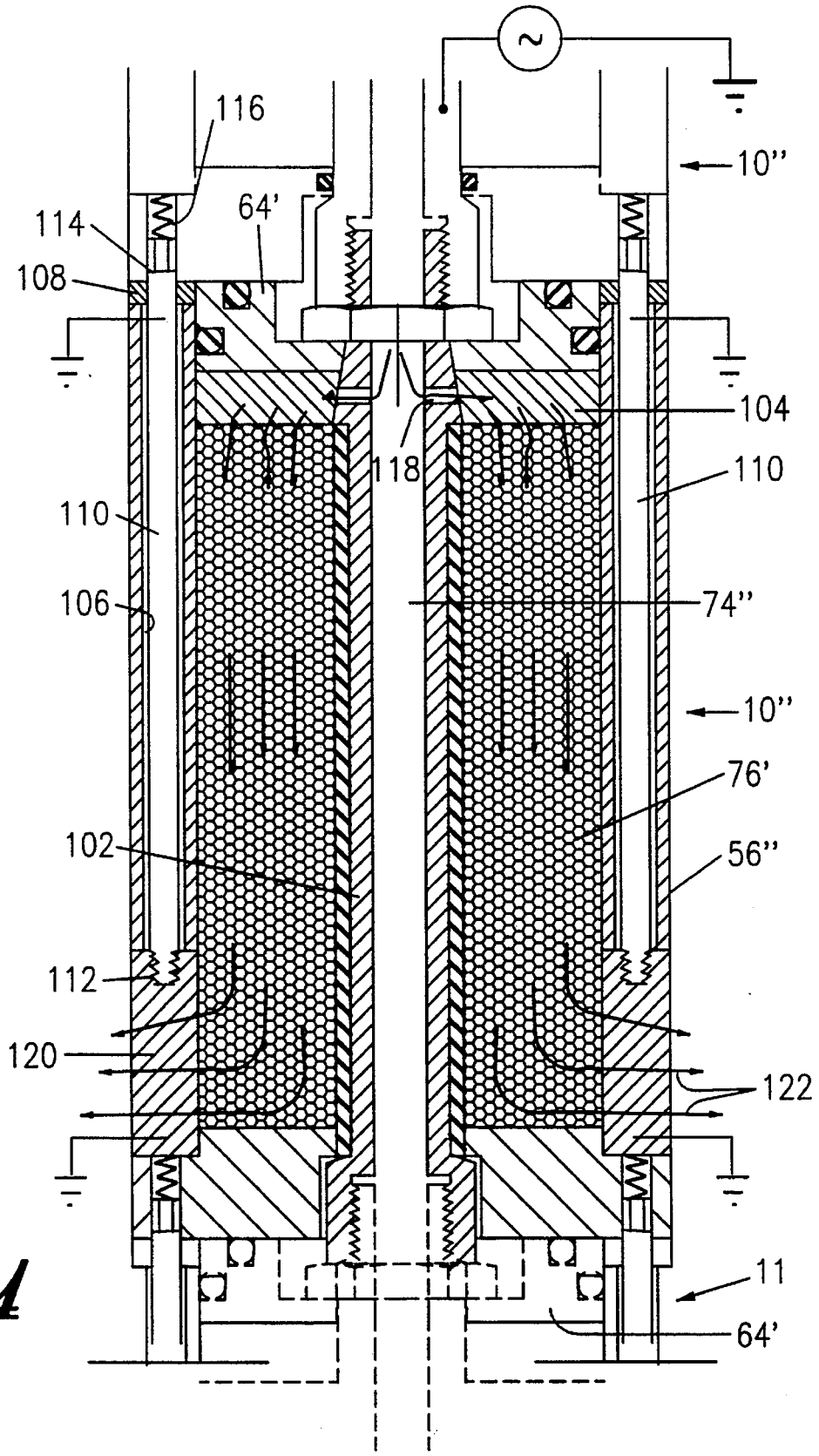
FIG. 4 is a cross-sectional view of a further modified steam generator of FIG. 2.

The generator structure 10", shown in FIG. 4, differs from the previous generators in that the water enters radially through the upper sintered metal electrode 104, under the end piece 64' that surrounds the cylinder 102, percolates therethrough then flows axially through the porous packing 76", where part of the water is turned to steam by the current flowing between the electrodes 104 and 120 through the water. The mixture of steam and water then exits radially through the sintered exit electrode 120, and enters the target formation as before. In this new structure, the spacing between electrodes 104 and 120 can be varied to accommodate different feedwater salinity and/or different voltages.

In the configuration of FIG. 4, the electrode spacing is no longer controlled by the diameter of the assembly.

There is also an outer non-conductive cylinder 90', made of non-conductive materials. Preferably there are four to six bores 106 drilled longitudinally through the cylinder and an annular top O ring insulator seal 108. For each hole a conductor rod 110 is inserted in the bore 106 which is of a lesser diameter than the bore. It is threaded at 112 into the sintered exit ring 120.

At the top 114 of rod 110 there is a spring 116 to conduct ground current to an upper generator 10", or directly to the cable of FIG. 8 if it is the top generator.

There is also provided the porous packing medium 76" as in the previous illustrations.

In operation, the voltage is applied between the conductor disk 104 and the exit electrode 120. Water coming down the space 74" will enter the disk 104 through openings 118 where it will be heated to some extent, then it will pass into the medium 76" where it will be vaporized and the steam will exit along with blowdown water as shown by arrows 122 through the outer sintered metal exit electrode 120.

Figure 5:
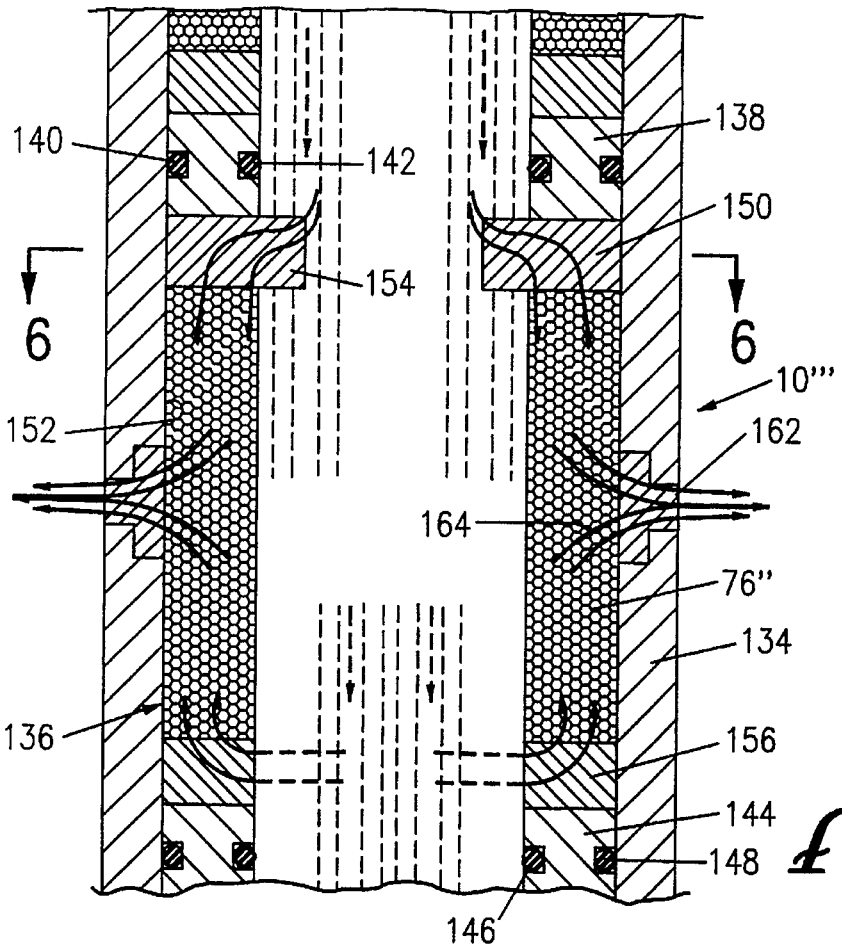
FIG. 5 is a cross-sectional view of yet another modified interior of the steam generator of FIG. 2.

FIG. 5 illustrates the first generator model 10'" designed specifically to use three phase power. Here there is an elongated non-conductive outer cylinder 134 that may be of any practical length and diameter to fit within the bore hole 12. The change comes in compartmentalizing the generator 10'". FIG. 5 illustrates one such compartment designated 136.

The compartment 136 is defined by an annular non-conductive top plate 138 that includes inner and outer O ring seals 140 and 142 and a lower non-conductive bottom plate 144 with inner and outer O ring seals 146 and 148.

There is also an upper sintered metal conductor disk 150 that has a diameter corresponding to the interior diameter 152 of the cylinder 134. The disk 150 has an opening 154, see FIG. 6 for the cable 18" to extend through on its way to another compartment 136. The disk 150 makes electrical contact with conductors 167, which also supply feedwater to the chamber through the sintered metal disk 150.

Adjacent the bottom plate 144 there is another sintered metal conductor disk 156 of the same construction as the disk 150. Disk 150 will make electrical contact with two different conductors 168, which carry a different phase of the power than 167.

Packed around the cable 18" and within the outer cylinder 134 is the porous packing medium 76'".

In operation, water passes down bores 158, which can be surrounded by electric cables 160, to the top conductive disk 150 and through additional bores 168 downward to the bottom sintered metal conductor disk 156. The water of course is heated by the current which flows between disks 150 and 156 and the steam will seek an opening and it will pass through the porous medium 76" to porous exit openings 162 as seen by the arrows 164.

Figure 6:
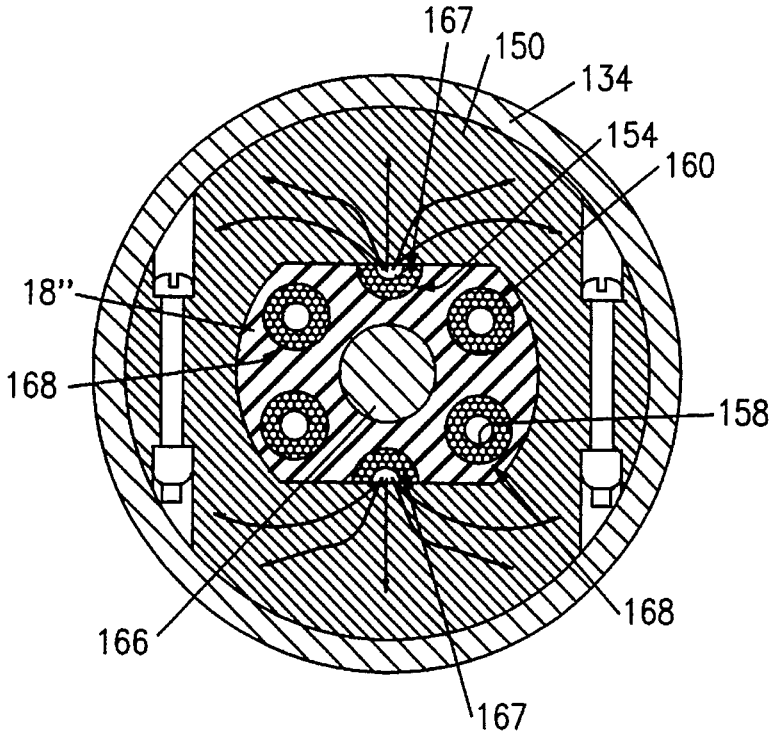
FIG. 6 is a cross-sectional view taken on line 6—6 of FIG. 5.

Because of the size and weight of the cable 18" a flexible reinforcing rod 166 may be inserted within the center of the cable 18". The rod may be of light weight composite material with structural strength. While the rod 166 is shown in FIG. 6, it may also be used in any of the other forms of cable illustrated or described. The number of conductors in the cable may also vary.

The metal for the sintered metal conductive disks and other modified conductors may be of nickel or other metallic materials capable of sintering, while being good electrical conductors and resistant to corrosion.

While the water bores 158 are shown with outer cable jackets 160, they could be reversed with the cable in the center and an annular opening around the core cable. Preferably the conductive cable is of copper.

Figure 9:
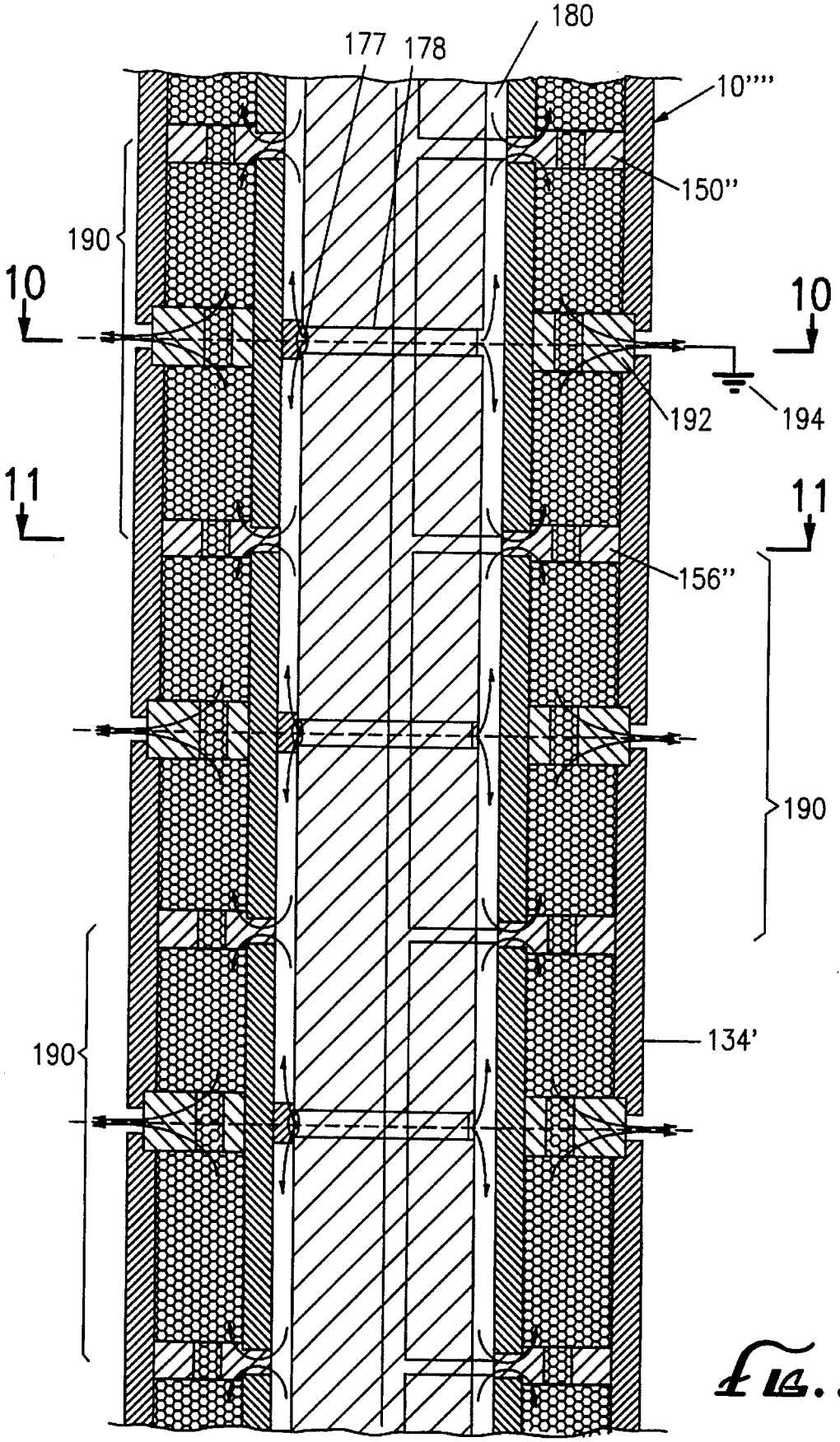
FIG. 9 is a further modified steam generator of FIG. 5.

The FIG. 9 configuration is designed to use a single water pipe instead of the six pipes shown in FIG. 6. To allow this modification, the water entry into each chamber of the 3-phase unit 10"" must be at ground potential. The generator has three identical steam generator chambers designated 190. The water is forced out the cable 18'" through a flow control jet 177 into an annular space 180, which is used as a pre-heating chamber. There is the non-conductive outer cylinder 134' and inner non-conductive baffle cylinder 188. The water flows axially upward and downward to the upper and lower sintered metal conductor disks 150" and 156", then through the packing 76 to the sintered exit ring.

The electrodes 150" and 156" are connected to two different phases of the three-phase power for example phases 1 and 2. There are two additional chambers below this chamber, which take power from phases 2-3 and phases 3-1, which in turn balances the power consumption of the three-phase assembly.

As many sets of these three chambers 190 as necessary may be stacked on one another to provide the steam necessary for the formation.

Each chamber 190 is defined by an upper sintered metal disk electrode 150" and a lower disk electrode 156", which also forms the top of the next lower chamber. Between the respective disk electrodes 150" and 156" is a central sintered metal disk electrode 192, which serves as the ground electrode with a connection to ground 194 [FIG. 10, bolt 198].

Sintered metal disk electrodes 150" or 156" and the exit disk 192 are different from previously described electrodes in that there are a plurality of packing port openings 196 so that the porous medium 76 may be poured from the end of the generator through the openings 196 to fill the generator during assembly.

Figure 10:
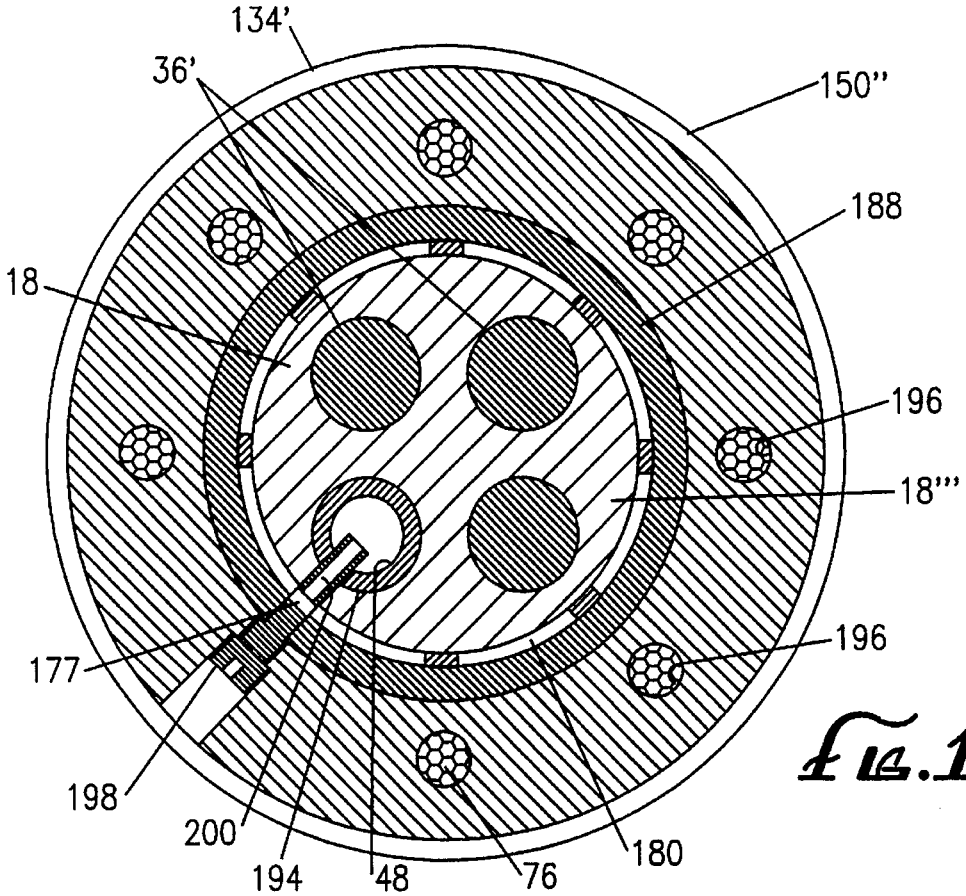
FIG. 10 is a cross section of the generator taken on line 10—10 of FIG. 9.

The inventor also provides a flow control bolt 198 that communicates with the water bore 48, see FIG. 10. The bolt 198 has a bore 200 that allows water to pass at a controlled rate into the pre-heat annular passage 180.

The flow control bolt 198 also acts as a ground for the disk and the water pipe 48.

As the water passes up and down in the preheat passage 180 as seen by the arrows of FIG. 9, it flows to one of the sintered metal disk electrodes. The heated water then flows through the electrode into the porous medium 76 where vaporization begins. The steam-water mixture flows axially through the medium 76 to the sintered metal exit ring 192 and then radially into the annulus and then into the formation, as seen in FIGS. 9 and 10. Current will flow through the water to ground 194' in both the preheat passage 180 and the porous medium 76 in each chamber 190.

Figure 11:
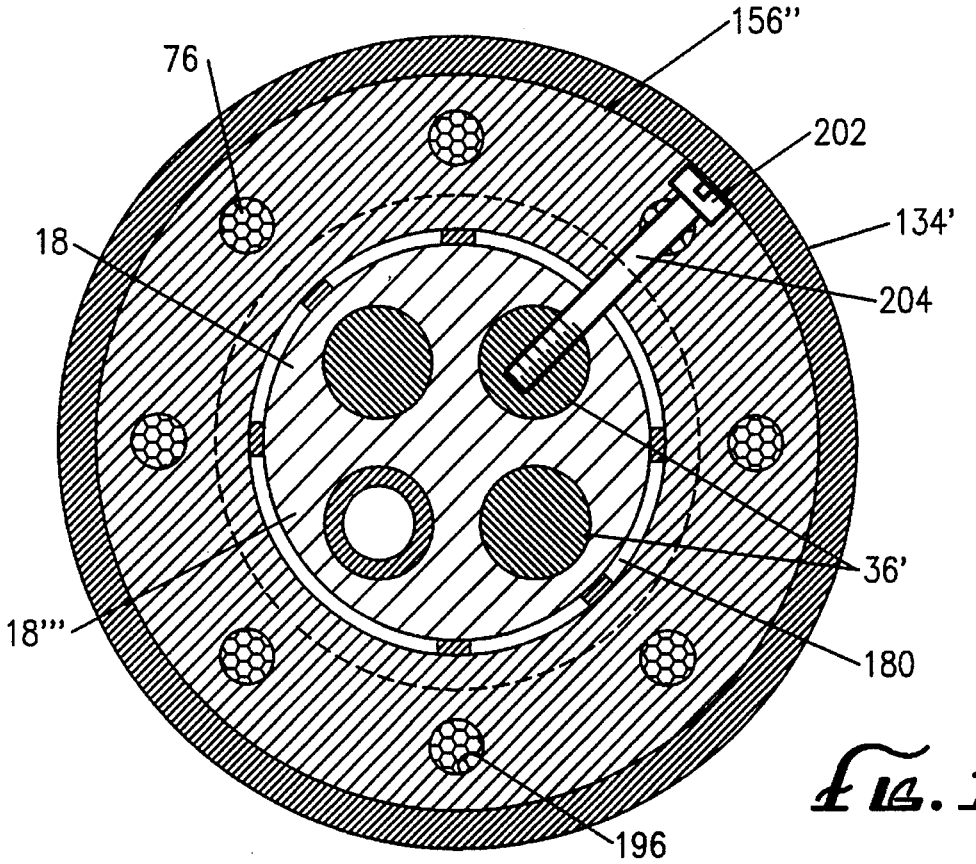
FIG. 11 is a cross section of the generator taken on line 11—11 of FIG. 9.

In FIG. 11 there is illustrated a connector bolt 204 in the disk 192 which carries current from the conductor 36' into the electrode.

Figure 12:
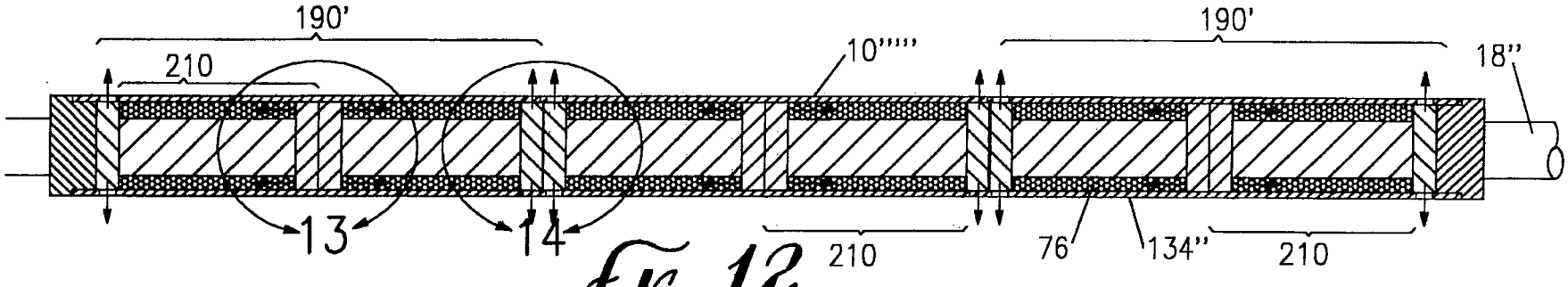
FIG. 12 is further modified steam generator of FIG. 9.
Figure 14:
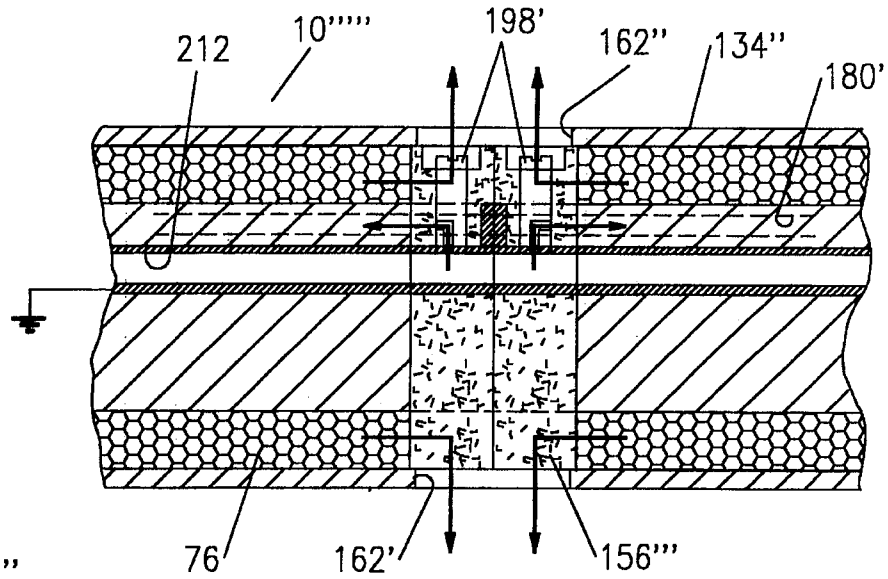
FIG. 14 is an enlarged sectional view of the circled area 14 of FIG. 12.
Figure 13:
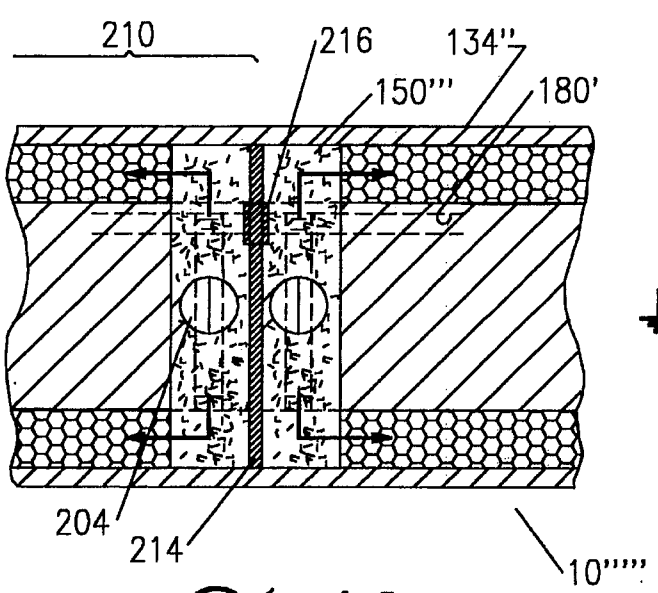
FIG. 13 is an enlarged sectional view of the circled area 13 of FIG. 12.

In FIGS. 12, 13 and 14 there is illustrated another modified three phase down hole steam generator unit 10'"".

There is an outer casing 134" that is a single tube with steam/water exit ports 162' that may be milled or otherwise formed therein.

The main distinction over the unit 10'''' of FIGS. 9, 10 and 11 is that while there are three chambers 190', each of the chambers 190' are divided into distinct sub-chambers 210. Each sub-chamber 210 has its own flow control jet 198', so that in the unit of FIG. 12 there are six flow control jets, each aligned with the exit ports 162". These jets 198' are located between the main water tube 212 and a pre-heat channel 180'.

Each of the sub-chambers 210 has its own high-voltage electrode 150''' and its own exit electrode 156''' which is at ground potential. Both high voltage and exit electrodes are preferably of sintered nickel.

In operation the water or brine will flow through the water tube 212 at ground potential, through the flow control jet 198' into the preheat channel 180' to and through the sintered electrode 156''' at high voltage, through the porous members 76 where steam forms through the exit electrode 156''', and out the opening 162".

However, the structure 10''''' also changes from the previous description in that each sub-chamber 210 is hydraulically isolated from a neighboring chamber by annular flow barriers 214 that extend across the interior of the casing 134". In the area of the pre heat chamber 180' an additional barrier 216 may also be imposed.

The unit still utilizes the porous media 76 as previously described The cable 18" contains the water tube 212.

In FIG. 13 there are illustrated the connector bolts 204 as in the previous embodiment.

The modified generator 10''''' illustrated in FIGS. 15 through 18 differ from most of the earlier modifications in that there is no central cable 18 or feed passage 74 or central electrodes 50 within the generator 10''''''.

Figure 15:
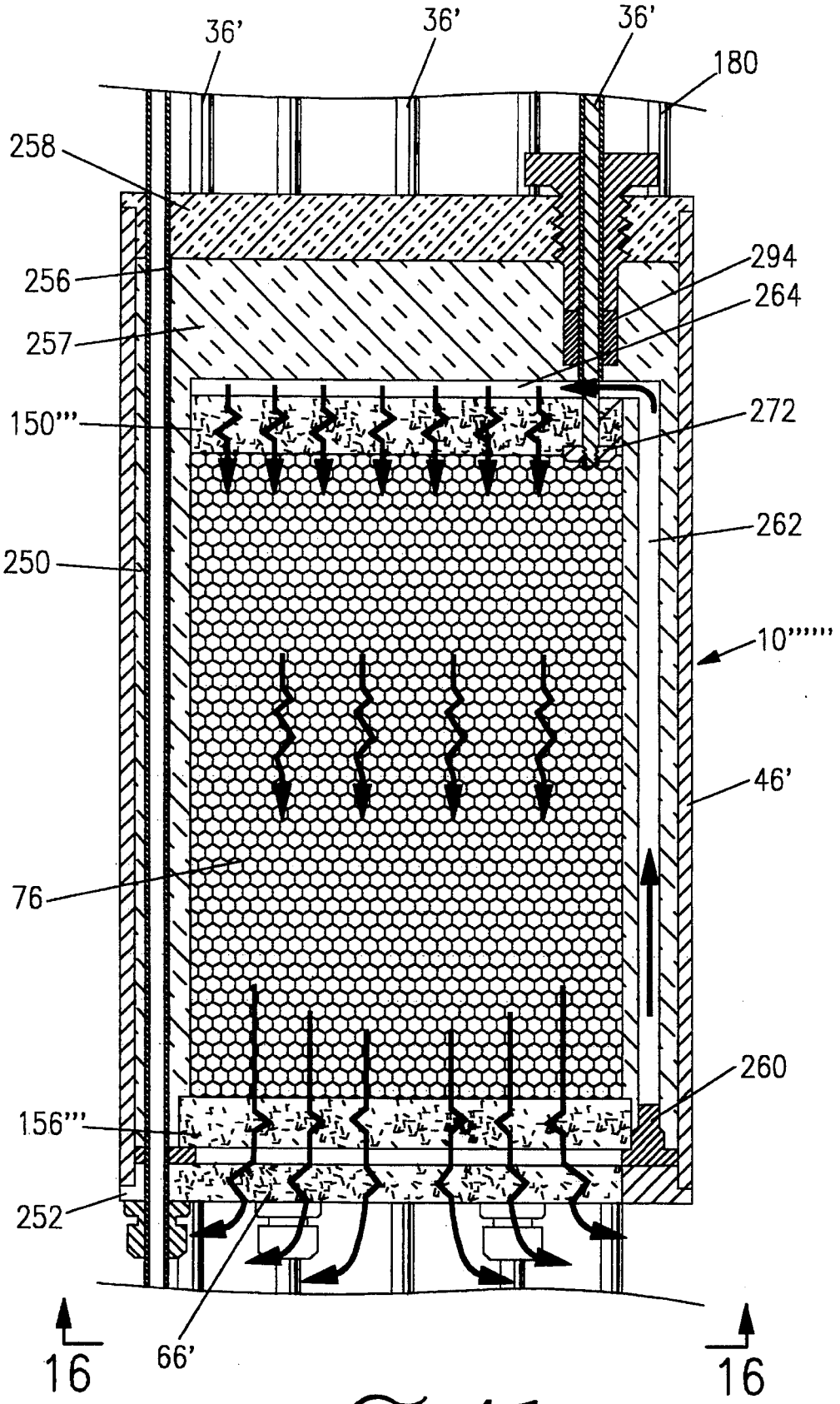
FIG. 15 is a modified side elevation cross-sectional view of a steam generator wherein there is no center post or conduits.

The modification of FIG. 15 preferably includes an outer annular metallic sheath 46' to protect the unit from damage. Inside the sheath is an inner casing or cylinder annular wall sleeve 250 with an elongated annular wall 250. This inner casing is preferably formed of a ceramic material to render it electrically non-conductive At the bottom 252 there is a bottom donut ring cap 66' that is porous and will allow steam to flow therethrough The top 256 of the wall 250 is closed with a top ring cap 258 of the same material as the inner casing. A potting material 257 may be added above the top of the inner casing 256 to protect it from damage.

The bottom ring cap 66' will retain a retainer ring 260 which in turn retains the annular ground electrode 156''', that may be formed of sintered metal or permeable carbon composite material or any other conductive material that will allow water and steam to percolate therethrough without the need for established bores or passages therethrough.

At the top area of the wall 250 there is an upper positive annular electrode 150''' which may be of the same compositions as set out above. Packed between the positive and ground electrodes 150''' and 156''' is the porous packing medium 76. The medium is to allow the water to convert to steam or hot water to pass out by gravity through the bottom electrode (in the direction of the arrows radially outward to the formation).

As can best be seen in FIG. 15, the water from above ground may pass down through tube 180 then back up water pipe extension 262 terminating in an upper generally horizontal void section 264 that extends across the high voltage electrode 150''' and therethrough as illustrate by the arrows. The tube or pipe 180, return pipe extension 262 will serve as a feedwater preheat channel. Thus as the preheated water passes by percolation through the electrode 150''' into the porous bead material 76 it is converted to steam or hot water and will exit by percolation through ground electrode 156''', through the open ring 66' and pass out radially as shown by the bottom arrows in FIG. 15.

The main distinction between the embodiment of FIGS. 15 and 16 and the others is that there is no core element in the center of the generator 10''''''. The feed water tube 180 and preheat chamber 262 are positioned at the annular radius of the generator either in the wall 250 or tubes may be mounted on the interior of the wall 250 abutting the same or in a longitudinal bead extension of the wall 250.

In FIG. 17 there is illustrated a three phase modified generator employing the construction of FIG. 15. In order to help maintain the unit there is preferably an outer relatively thin annular jacket 270. Mounted in tandem in series within the jacket 270 are six generators 10''''' one being united to the other in spaced relationship and maintained to one another by high voltage sheathed wires or conductors 36' that pass, one to the top electrode of a generator 10''''' where it is conducted at 272. A seal 274 may be of a high temperature elastomer may insulate the wires both electrically and hydraulically.

The remaining conductors 36" pass through the wall 250 to the next two downhole generators 10''''' of the three phase and finally to the last of the two three phases generators 10''''''.

In addition, there are six separate feedwater tubes 180 positioned around the circumference of the generator 10''''''. One tube enters the top generator and is connected to the preheat channel 262 and the remaining tubes extend through the generator 10''''' to the next and then on to the next generator. In this way each generator has its own feedwater supply.

There are also six separate electrical conduits 36' that are also positioned around the circumference of the generator 10''''''. As with the feedwater tubes 180, one tube enters the top generator and is connected to the electrodes 150''' and the remaining conduits 36' extend through a generator 10''''' to the next and then on the next generator. In this way each generator has its own electrical conduit 36'.

In order for the steam or hot water to move radially outward from the generators when in the tandem arrangement of FIG. 17 there are a plurality of longitudinal slots 276 around the jacket 270 between the generators, see FIGS. 17 and 18. With the slots 276 the steam may escape as seen by the arrows in FIG. 17.

While the modification of FIG. 17 shows a three-phase system power that supplies two generators, the concept may be extended to include a nine or twelve chamber unit where more power and steam would be required.

Further, these units basically produce steam, but it should be recognized that the production of hot water to penetrate oil pockets or tar sand may be used without departing from the spirit of the invention.

As indicated above there are various materials that may be used in forming the sintered parts within the invention, and the inventor is not limited to one specific material.

In addition, the porous packing medium 76 is preferably ceramic beads 77. However, other materials that can be made into beads or small pieces where water passages may be formed therebetween when packed together may be used without departing from the spirit of the invention.

It is necessary that the medium have the spaces so as to form circuitous passages to even out the flow of water and steam. Also the material and size of the beads 77 may vary when dealing with different water salinities and/or pressure drop.

Insulation for the cable 18 could be a high temperature thermoplastic such as EPDM for flexibility, abrasive resistance, and smooth surface.

Throughout the application the basic use for the generator has been for use in rendering oil less viscose. However, the inventor envisions other uses for the generator such as in the treatment of toxic waste or the liquification of oil and toxic waste in the ground underneath abandoned oil storage tanks.

A hole could be bored beneath the old storage tank area and the generator inserted to liquify or reduce the viscosity of old oil and/or toxic material that has seeped into the ground. With liquification by steam or hot water the residue is much easier to manage and remove.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A downhole radial flow steam generator for oil wells that is adapted to be inserted into an annular well casing having openings therethrough, said generator adapted to be suspended from a flexible cable that carries water and electricity to said generator from above ground comprising:

an outer casing of a diameter less than interior diameter of aid annular well casing and having a construction to allow steam generated therein to radially pass therethrough and through said well casing;

at least two spaced apart electrodes adapted to be chargeable from said flexible cable forming a part of said generator, to convert water therebetween supplied from said flexible cable to steam; and a non-conductive porous medium packed in said outer casing between electrodes and of such a construction adapted to allow steam and brine to pass through said outer casing, said medium is of such a configuration as to provide circuitous passages to allow flow resistance to water and steam and said medium is capable of receiving water to wet, said medium allowing a path for electric current while also allowing steam to pass therethrough.

2. A downhole radial flow steam generator system as defined in claim 1 wherein:

said flexible suspension cable includes one or more electrical conductors extending to said generator; and a reinforcing member is included within the cable extending the depth that said cable may be used.

3. A downhole radial flow steam generator system as defined in claim 1 wherein:

there is a pre-heating channel to receive water from said water passage before being converted to steam.

4. A downhole radial flow steam generator for oil wells as defined in claim 1 wherein:

said electrodes are made of a sintered metal which is adapted to allow indirect passage of water and steam therethrough.

5. A downhole radial flow steam generator for oil wells as defined in claim 1 wherein:

said outer casing is annular, and said electrodes are annular disks that fit within said casing and engage the casing therearound with one disk spaced from the other; and said disks are adapted to indirectly channel water therethrough into said porous medium where steam may be forced radially out from said generator.

6. A downhole radial flow steam generator for oil wells as defined in claim 5 wherein:

there are three electrodes fitted within said casing with said porous medium packed therebetween.

7. A downhole radial flow steam generator for oil wells as defined in claim 5 wherein:

each of said annular disk electrodes include a top and bottom surface generally parallel with each other, and each disk includes at least one packing channel passing through from said top and bottom surface to allow said porous medium to pass therethrough to fill chambers therebelow.

8. A downhole radial flow steam generator for oil wells as defined in claim 1, wherein:

said porous medium is ceramic beads of such a configuration as to provide circuitous passages for said steam passing therethrough.

9. A downhole radial flow steam generator unit wherein a plurality of steam generators, each defined as in claim 1, are fixed together for simultaneous steam production.

10. A downhole radial flow steam generator unit for oil wells as defined in claim 9 wherein:

each generator includes top and bottom coupling means adapted to carry electricity and water from one generator to the other.

11. A downhole radial flow generator system comprising at least one downhole radial flow generator, said system capable of creating steam or hot water and said generator is adapted for insertion into a bore, said generator suspended from a flexible cable that carries conductive salt water and high voltage current to said generator from above ground, said generator comprising:

an outer casing of a diameter less than the interior diameter of said annular bore;

an inner electrically non-conductive casing abutting said outer casing;

a pair of annular porous electrodes one high voltage and one ground each spaced one from the other in said inner casing forming top and bottom porous cap elements to allow water to indirectly percolate therethrough and said high voltage current passes to said electrodes from a position at least adjacent to the inner annular casing and said electric current passes to conductive brine passing therethrough;

at least one water passage from said flexible cable extending into said generator at least adjacent to said inner annular casing;

a porous non conductive non heat transferring medium packed into said inner casing between said electrodes having connected voids therethrough whereby fluid is capable of circuitously passing through; and said brine will wet said medium to assure a conductive path for electric current while providing for a passage of steam through said medium; and a donut shaped bottom retainer ring having an interior void adjacent said ground electrode wherein either said steam or hot water generated will pass through said void in said retainer ring and radially outwardly therefrom into earth to be treated.

12. A downhole radial flow generator system as defined in claim 11 wherein:

there are a set of three generators arranged in a three-phase y configuration for simultaneously creating steam or hot water, said generators arranged in vertically spaced relationship;

said generators each include separate passage means at least adjacent to said inner casing to carry said hot water and said high voltage to each of said generators; and an elongated annular sleeve surrounding said generators, said sleeve include vertical slots therein in the area between said generators to allow said steam or hot brine to radially escape into an appropriate earth formation.

13. A downhole radial flow generator system as defined in claim 12 wherein:

there is a separate water passage and high voltage passages to each set of generators.

14. A downhole radial flow generator system of claim 11 wherein:

a feedwater preheat channel connects to said water passage projecting upward at least adjacent to said casing; and a water passage over said top positive electrode is adapted to feed preheated water to said top positive electrode.

15. A downhole radial flow generator as defined in claim 11 wherein;

said electrodes are permeable carbon material which is adapted to allow percolation passage or water or steam therethrough.

16. A downhole radial flow generator as defined in claim 11 wherein:

a high voltage wire is provided carrying current from said flexible cable and said water passages are formed in said annular inner casing.

17. A downhole radial flow generator as defined in claim 11 wherein said inner electrically non-conductive casing is formed of ceramic.

18. A downhole radial flow generator as defined in claim 11 wherein said at least one water passage is at least one tube mounted inwardly of said inner electrically non-conductive casing.

19. A downhole radial flow generator as defined in claim 11 wherein:

an insulated high voltage wire carrying current from said flexible cable is mounted within said inner electrically non-conductive casing.

20. A downhole radial flow generator as defined in claim 11 wherein:

said porous non-conductive medium is a plurality of ceramic beads packed together.

* * * * *